US010092108B2

(12) United States Patent
Varga

(10) Patent No.: US 10,092,108 B2
(45) Date of Patent: Oct. 9, 2018

(54) DUAL HEIGHT BOOSTER SEAT

(71) Applicant: Ernest J. Varga, Richmond, IL (US)

(72) Inventor: Ernest J. Varga, Richmond, IL (US)

( * ) Notice: Subject to any disclaimer, the term of this patent is extended or adjusted under 35 U.S.C. 154(b) by 0 days.

(21) Appl. No.: 15/140,735

(22) Filed: Apr. 28, 2016

(65) Prior Publication Data

US 2016/0316914 A1 Nov. 3, 2016

Related U.S. Application Data

(60) Provisional application No. 62/155,523, filed on May 1, 2015.

(51) Int. Cl.
*A47C 3/38* (2006.01)
*A61G 5/10* (2006.01)

(52) U.S. Cl.
CPC ..... *A47C 3/38* (2013.01); *A61G 5/1091* (2016.11)

(58) Field of Classification Search
CPC ..... A47C 3/38; A47C 1/16
USPC ..... 297/1, 2, 3, 92, 105, 130, 250.1, 256.14, 297/256.11, 283.1
See application file for complete search history.

(56) References Cited

U.S. PATENT DOCUMENTS 1,353,066 A * 9/1920 Pascoe ..... A47D 1/04 297/131
2,269,834 A 1/1942 Wagner
D144,404 S 4/1946 Mabry
2,440,979 A 5/1948 Schneider
2,521,281 A 9/1950 Brousseau
2,541,612 A 2/1951 Ricketson
2,622,658 A 12/1952 Morgan
2,776,700 A * 1/1957 Potter ..... A47C 4/021 297/183.1
3,250,569 A 5/1966 Gaffney
3,265,437 A * 8/1966 Mincieli ..... A47C 7/38 297/230.12
3,556,586 A * 1/1971 Beardmore ..... A47B 83/02 297/118
3,575,465 A 4/1971 Dolby
3,592,506 A 7/1971 Breslow
4,181,352 A * 1/1980 Bumpus ..... A47D 11/002 108/91
4,205,876 A 6/1980 Cetina
4,521,052 A * 6/1985 Cone ..... A47D 1/02 297/1

(Continued)

FOREIGN PATENT DOCUMENTS

DE G B1 02 207.7 * 1/1981 ..... A47C 8/00

*Primary Examiner* — Timothy J Brindley
(74) *Attorney, Agent, or Firm* — Bishop Diehl & Lee, Ltd.

(57) ABSTRACT

A dual-height seat riser or booster provides an elevated seating surface for an adult individual when positioned on, for example, a bench or pew surface. The riser includes a pair of sidewalls having upper and lower edges and a seat member fixed offset to a midline so as to be closer to the upper edge of the sidewall and positioned at an angle so as to slope downward. The riser is configured such that when positioned on a bench with the lower edge of the sidewalls down and the front edge of the seat member forward, the seat member is at a first height, approximately 4 to 16 inches, and when the riser is inverted with the upper edge down and the rear edge forward, the seat member is at a second height, approximately 2 to 8 inches.

11 Claims, 4 Drawing Sheets

(56) References Cited

U.S. PATENT DOCUMENTS

| | | | | | |
|---|---|---|---|---|---|
| 4,586,747 | A * | 5/1986 | Taylor | A47D 1/004 297/181 |
| 4,629,162 | A | 12/1986 | Porche | |
| 4,772,068 | A * | 9/1988 | Gleckler | A47C 7/002 248/188.5 |
| 4,836,605 | A | 6/1989 | Greenwood et al. | |
| 4,867,504 | A | 9/1989 | Johnson, Jr. | |
| 5,082,327 | A | 1/1992 | Crisp | |
| 5,114,209 | A * | 5/1992 | Dunn | A47C 7/425 297/230.1 |
| 5,332,286 | A * | 7/1994 | Atherton | A47D 1/103 297/188.14 |
| 5,333,931 | A | 8/1994 | Weddendorf | |
| 5,375,911 | A | 12/1994 | Morrow | |
| 6,155,641 | A * | 12/2000 | Frost | A47D 1/04 108/11 |
| 6,367,874 | B2 | 4/2002 | Casini | |
| D496,166 | S | 9/2004 | Namikawa | |
| 6,983,991 | B2 | 1/2006 | Strona | |
| 7,014,266 | B2 * | 3/2006 | Selby | A01B 75/00 108/158.12 |
| D602,270 | S | 10/2009 | Castro, Jr. | |
| 7,862,122 | B1 | 1/2011 | Shammas | |
| 7,931,339 | B1 | 4/2011 | Stocker et al. | |
| 8,282,171 | B1 | 10/2012 | Stocker et al. | |
| 2002/0149240 | A1 * | 10/2002 | Minneman | A01M 31/025 297/188.01 |
| 2005/0200180 | A1 | 9/2005 | Guyton et al. | |
| 2008/0164745 | A1 * | 7/2008 | Nichols | A47C 3/16 297/452.48 |
| 2013/0307304 | A1 * | 11/2013 | Gillett | B60N 2/2866 297/256.11 |
| 2015/0265057 | A1 | 9/2015 | Atayan et al. | |

* cited by examiner

DUAL HEIGHT BOOSTER SEAT

RELATED APPLICATION

This application claims the filing priority of U.S. Provisional Application No. 62/155,523, titled "DUAL HEIGHT BOOSTER SEAT," and filed on May 1, 2015. The '523 Provisional Application is hereby incorporated by reference.

TECHNICAL FIELD OF THE INVENTION

The present application relates to seating accessories. Particularly, the application relates to seating accessories for those who may have trouble sitting and/or standing after sitting, such as elderly and those with knee, hip or other lower body restrictions.

BACKGROUND OF THE INVENTION

As people age, they can be faced with increasing challenges in performing everyday tasks. One such challenge is sitting in standard seats. For most people falling within a wide range of what might be considered "normal" height, sitting requires bending at the knees and hips to, and sometimes beyond 90 degrees. Lowering a substantial amount of one's body weight to such a level can be challenging enough where leg muscles and ligaments, as well as knee and hip joints, may not be as strong due to age, surgical procedure, permanent medical condition, temporary illness or some debilitating injury (collectively "impaired individuals"). However difficult sitting may be for an impaired individual, an even greater challenge for such individuals is what eventually follows, i.e., rising from the seated position.

While difficult for some in most seat types, standing can be particularly difficult for impaired individuals using bench seating where there are no armrests for which to grasp and assist in the standing process. Benches are a popular form of seating in many places of public gathering, including churches, courtrooms, government meeting halls, stadiums, gymnasiums, auditoriums, and even some casual restaurants. Not all patrons and guests of these venues may have the physical ability to stand from a seated position. Where the task of sitting and standing is often repeated (e.g., church, sporting events, court, and the like), the difficulty in or inability to stand may cause some impaired individuals to avoid such places.

The invention of the present application is designed to address the sitting and standing problem faced by impaired individuals. The disclosed device provides a comfortable and effective seat for impaired individuals and facilitates sitting as well as standing from the seated position with numerous advantages in manufacture, simplicity and effectiveness.

SUMMARY OF THE INVENTION

There is disclosed herein an improved booster seat which avoids the disadvantages of prior devices while affording additional structural and operating advantages.

Generally speaking, the booster is comprised of a dual height seat riser which provides an elevated seating surface on, for example, a bench surface. In a preferred embodiment, the riser comprises a pair of sidewalls having upper and lower edges and a seat member having first and second edges and fixed between the sidewalls above a midline so as to be closer to the upper edge of the sidewall and positioned at an angle so as to slope downward from about 5 to about 25 degrees from the second to the first edge. The riser is configured such that when positioned on a bench with the lower edge of the sidewalls down and the first edge of the seat member forward, the seat is at a first height, and when the riser is positioned with the upper edge down and the second edge forward, the seat member is at a second height different from the first height.

In a specific embodiment, the dual height seat riser further comprises at least one handle in each of the sidewalls. Further, an embodiment may also include a stabilizer fixed between the sidewalls to prevent bowing.

In the preferred embodiments, the first height of the riser is elevated in the range of from about 4 to about 8 inches above the bench surface and the second height is elevated in the range of from about 2 to about 4 inches above the bench surface. As the riser is customized for different body types and sizes, as well as different maladies, the preferred elevation ranges of the first height, the second height or both may change.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
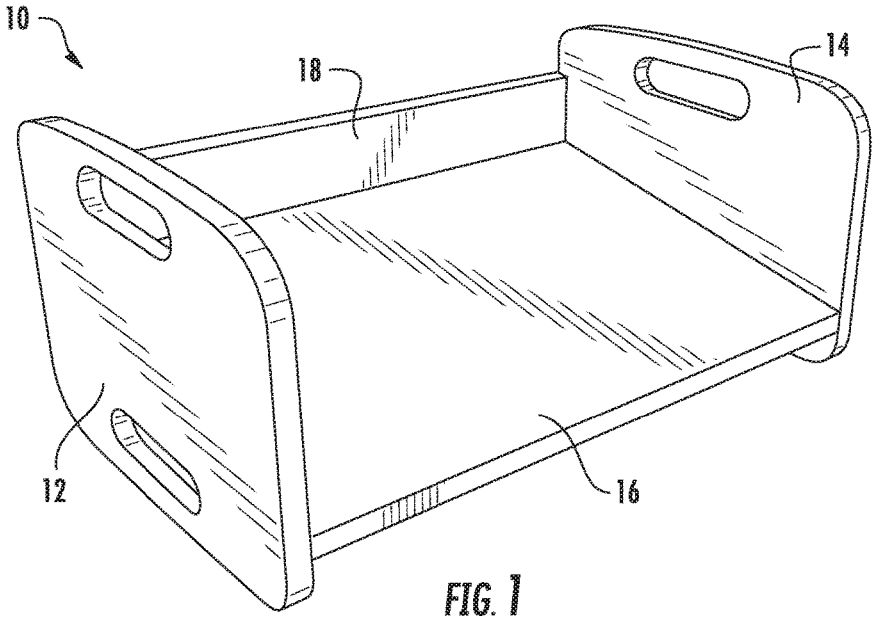
FIG. 1 is a perspective view of a first orientation of a preferred embodiment of the disclosed seat riser.

While this invention is susceptible of embodiments in many different forms, there is shown in the illustrations and will herein be described in detail at least one preferred embodiment of the invention with the understanding that the present disclosure is to be considered as an exemplification of the principles of the invention and is not intended to limit the broad aspect of the invention to any of the specific embodiments illustrated or described.

Generally speaking, with reference to the numerous appended drawings, the disclosed seat riser 10 is comprised of left and right sidewalls 12, 14, a seat member 16, supported between the two sidewalls, and a stabilizer 18, also fixed between the sidewalls to provide structural integrity to the riser 10. The riser 10 is preferably used to provide an elevated seat from a bench upon which it is positioned. The user of the riser 10 is provided with a higher seating surface, making it easier to both sit on the elevated surface and stand from the elevated surface, especially with use of the accompanying side handles 20 which provide upper body-assisted sitting and standing, if desired.

As illustrated in a preferred embodiment, the sidewalls 12, 14 are substantially parallel to one another with four (4) rounded corners for both safety and to allow better positioning of the riser 10 on many bench types. The seat member 16 is preferably set at an angle within a range of from about 10 to about 15 degrees from horizontal, as will be explained further below. The seat member 16 is also fixed between the sidewalls 12, 14 above a midline such that it is positioned closer to one of either the top or bottom edge of the sidewalls 12, 14. It may be fixed within the sidewalls using any suitable means and in any suitable manner known by those of skill in the art.

In the illustrated embodiment, the seat riser 10 has two usable positions as a result of the position of the seat member 16 between the sidewalls 12, 14. These two positions are intended to accommodate users of different heights—e.g., an adult male and a shorter adult female. The two positions are created as a result of the placement of the seat member 16 between the two sidewalls. As illustrated, the seat member 16 is approximately 18 inches (about 45.7 cm) long, measured front to back, and about 24 inches (61.0 cm) wide, measured side to side, with a rising pitch (front to back) preferably in the range of from about 5 to about 25 degs., more preferably in the range of about 10 to about 15 degs., and most preferably the angle is of a degree which is sufficient to offset the rearward slope of the existing sitting surface it is positioned on (e.g., a church pew). These approximate dimensions are believed to be suitable for most applications, but are by no means limiting on the possible dimensional variations which would be understood by one of ordinary skill in the art.

The angle or pitch of the seat member 16, as noted above, is to offset the rearward slant of the base surface such as a church pew. Typically, such seating surfaced are angled rearward, which makes it considerably more difficult for individuals to rise form. Based on the size of seat member 16 in a first position illustrated in FIG. 1, with the first edge of the member 16 elevated approximately 2 inches (about 5.1 cm) above the bench surface, the second edge would be elevated in range of from about 5.1 inches (about 13.0 cm) at 10 degs., to about 6.5inches (about 16.5 cm) at 15 degs., above the bench surface. Similarly, in the second configuration illustrated in FIG. 2, where the front of the seat member 16 is elevated about 4inches (about 10.2 cm) above the bench surface, the second edge of the seat member 16 would be about 7.1 inches (about 18.0 cm) at 10 degs., to about 8.5 inches (about 21.6 cm) at 15degs., above the bench surface. Obviously, these heights and angles may be changed to accommodate a specific user or group of users, as desired.

The sidewalls 12, 14 should be spaced at a distance sufficient to accommodate a user seated there between. Handles 20 should also be provided on both sidewalls and proximate both top and bottom edges of each sidewalls, as shown. The handles 20 allow the riser 10 to be carried more easily and also permit grasping by a user for stabilization and use of upper body strength as he/she sits or stands.

The seat member 16, while preferably a single flat surface, may be comprised of two parts with the ability to expand and contract (at the time of initial fabrication) in some manner so as to provide adjustment of the seat width, as necessary. Those of skill in the art would understand the various ways in which the adjustment feature may be implemented. Also, though not shown, the seat member 16 may be contoured or cushioned on both surfaces to provide more comfortable seating, especially prolonged sitting, to the user. Of course, it is imperative that the seat member 16 be constructed so as to be capable of supporting the weight of a user.

Figure 2:
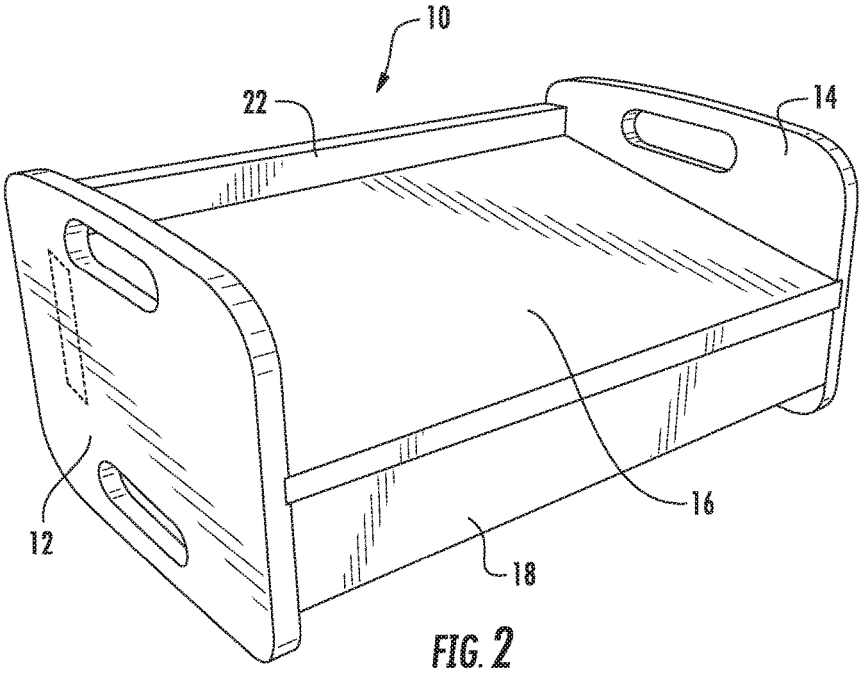
FIG. 2 is a perspective view of a second orientation of the embodiment shown in FIG. 1.
Figure 3:
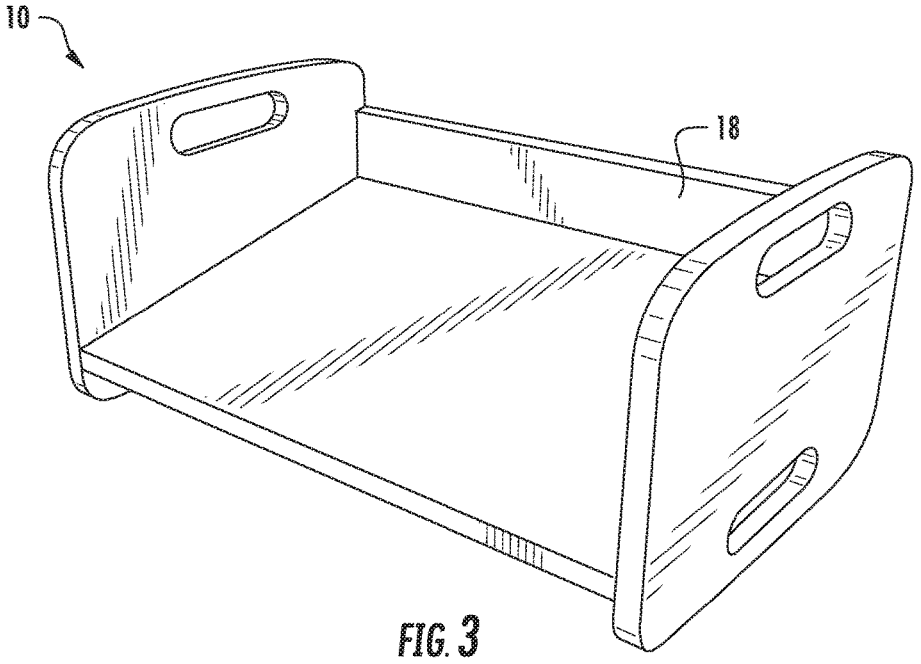
FIGS. 3 and 4 are top views of the first and second orientations illustrated in FIGS. 1 and 2, respectively.
Figure 4:
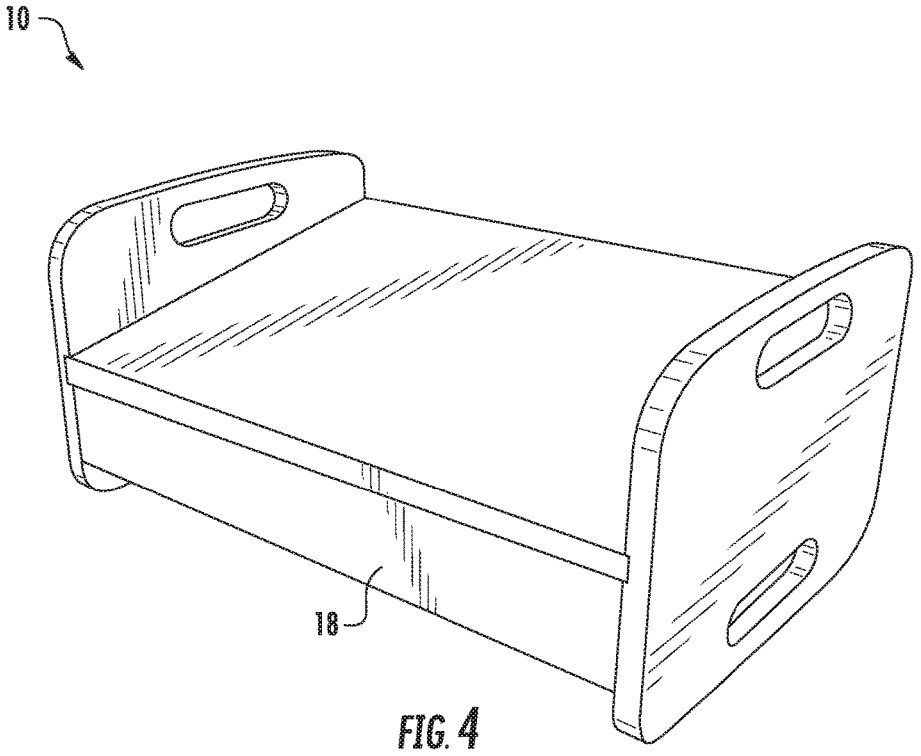
Figure 5:
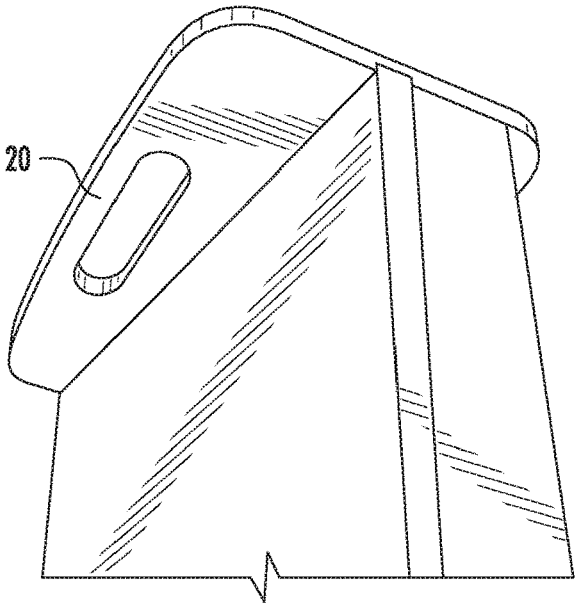
FIGS. 5 through 9 are various partial views illustrating unique features described for the preferred embodiment of FIGS. 1 and 2.
Figure 6:
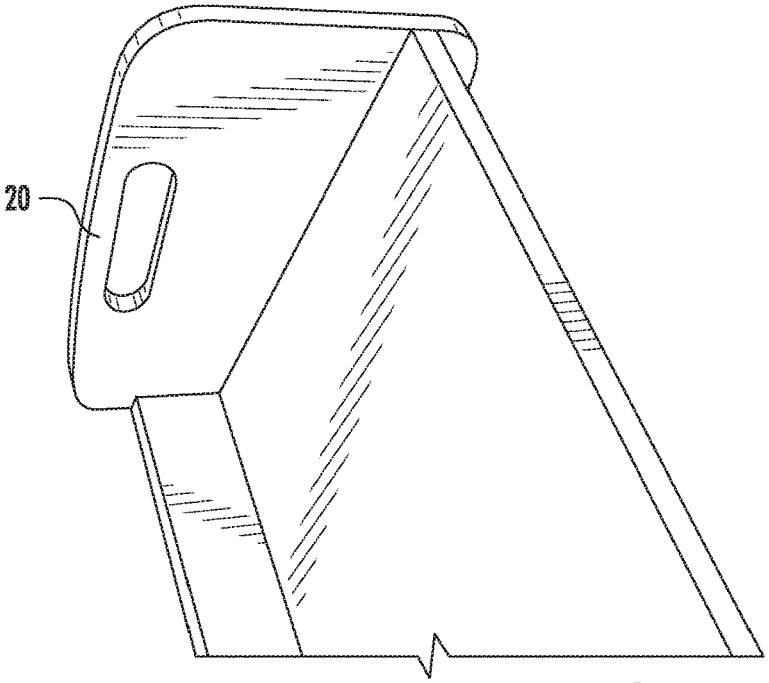
Figure 7:
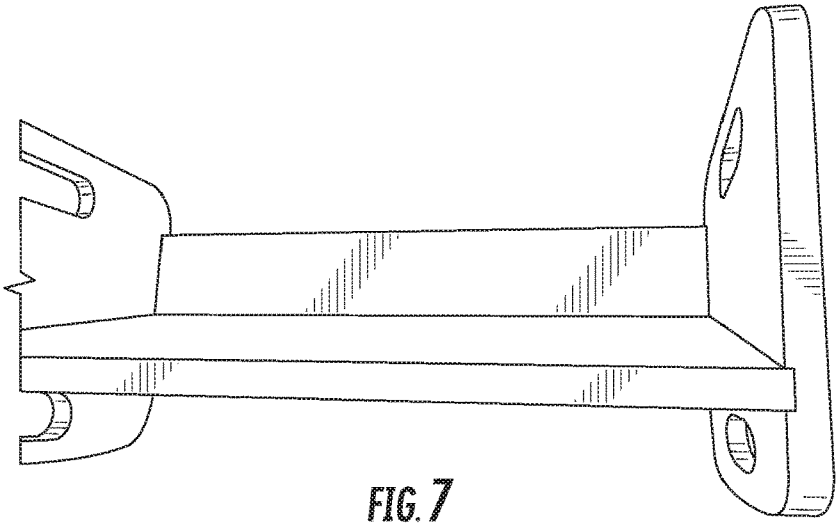
Figure 8:
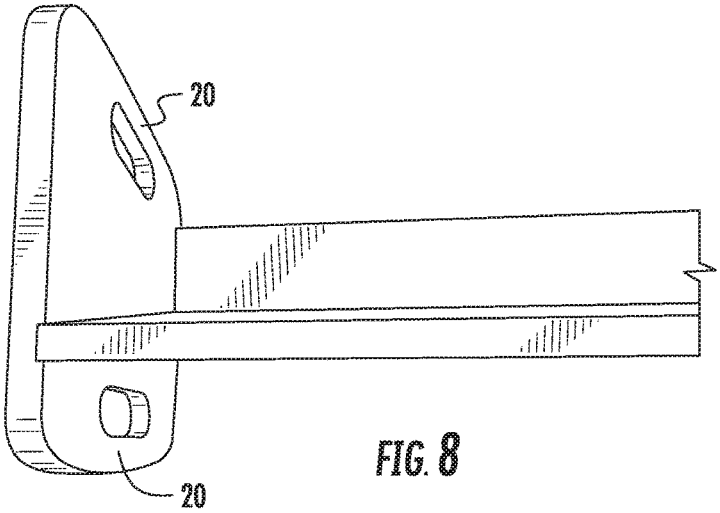
Figure 9:
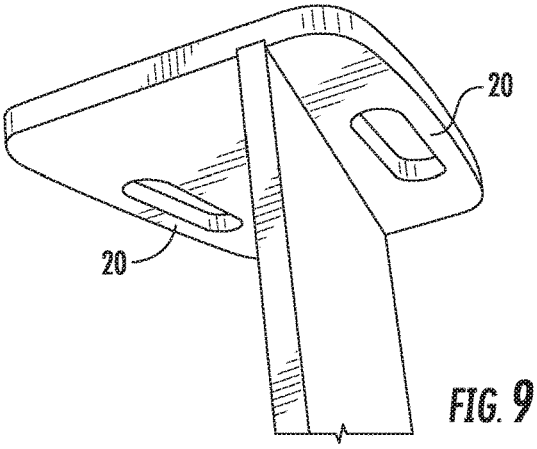

The stabilizer 18 is used to keep the sidewalls 12, 14 from "bowing" outward or collapsing to the side during use. It is preferably positioned along the back edge of the seat member 16 as viewed in the first configuration (FIG. 1). This allows a much wider stabilizer than what might be used in the same location for the second configuration (FIG. 2). That said, a second stabilizer 22, if needed, could be placed along the back edge of the seat member 16 as viewed in the second configuration (FIG.2).

In a preferred embodiment, the sidewalls 12, 14, seat member 16 and stabilizer 18 are all constructed of wood, including solid, laminate and composite boards. Wood is strong, easy to cut and finish, and provides a quality product able to blend with many decors. However, manufacturing may be simplified and costs reduced through the use of suitable high-strength plastics, polymers, composites, alloys or other synthetic materials. Similarly, the use of a molding process—e.g., injection molding, blow molding, thermoforming, or other similar suitable processes—to pre-fabricate components for user assembly, may be implemented as well.

Regarding construction, the seat member 16 is preferably permanently secured to each of the sidewalls 12, 14, sloping from the second edge downward to the first edge, as previously described. The sloping is, at least in part, for the purpose of offsetting any backward slope of a bench seat upon which it is positioned-noting that such rearward sloping seats can be extra difficult to stand from impaired individuals-and to provide a level sitting surface to facilitate sitting and standing for impaired individuals.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicant's contribution. The actual scope of the protection sought is intended to be defined in the following claims when viewed in their proper perspective based on the prior art.

What is claimed is:

1. A seat riser for providing an elevated seating surface on a bench, the riser comprising:

a pair of sidewalls having upper and lower edges; and a seat member having first and second faces being attached between the sidewalls in an offset manner so as to be closer to the upper edge of the sidewalls; in a first orientation, the first face of the seat member facing upward and that seat member having a downward slope within range of 5 to 25 degrees from a back first edge to a front second edge, and in a second orientation, the second face of the seat member facing upward and the seat member having a downward slope within range of 5 to 25 degrees from a back second edge to a front first edge, wherein the back first edge is the front first edge and the front second edge is the back second edge;

wherein, when the riser is positioned on a surface with the lower edge of the sidewalls contacting the surface the seat member is at a first height relative to the surface, and when the riser is positioned with the upper edge of the sidewalls contacting the surface the seat member is at a second height, relative to the surface, different from the first height, further comprising a first stabilizer fixed between the sidewalls to prevent bowing and collapsing wherein the first stabilizer is fixed along the back second edge and second face of the seat member and a second stabilizer fixed between the sidewalls along the back first edge and first face of the seat member.

2. The seat riser of claim 1, further comprising at least one handle positioned in each of the sidewalls.

3. The seat riser of claim 2, wherein the sidewall comprises a two handles, with one proximate the upper edge and one proximate the lower edge.

4. The seat riser of claim 2, wherein the at least one handle comprises an opening in the sidewall.

5. The seat riser of claim 3, wherein each of the two handles in each sidewall comprises an opening in the sidewall.

6. The seat riser of claim 1, wherein elevation of the first height is in a range of from 4 inches to 16 inches above the bench surface and elevation of the second height is in a range of from above 2 inches to 8 inches above the bench surface.

7. The seat riser of claim 1, wherein the angle of the seat member is in a range of from 10 to 15 degrees.

8. A dual-height booster seat for positioning on a bench having a seating surface with a slightly rearward slope, the booster seat comprising:

a first sidewall having upper and lower edges;

a second sidewall having upper and lower edges;

a seat member having first and second faces, in a first orientation, the first face of the seat member facing upward and the seat member having a downward slope within range of 5 to 25 degrees from a back first edge to a front second edge, and in a second orientation, the second face of the seat member facing upward and the seat member having a downward slope within range of 5 to 25 degrees from a back second edge to a front first edge, wherein the back first edge is the front first edge and the front second edge is the back second edge;

a plurality of handles positioned within the first and second sidewalls, with one located proximate each the upper and lower edges, wherein the plurality of handles are configured for grasping by an individual seated on the seat member; wherein, when the seat riser is positioned on the seating surface with the lower edge of the sidewalls contacting the surface the seat member is at a first height relative to the surface, and when the riser is positioned with the upper edge of the sidewalk contacting the surface the seat member is at a second height, relative to the surface, different from the first height, and further comprising a first stabilizer fixed between the sidewalls to prevent bowing and collapsing wherein the first stabilizer is fixed along the back second edge and second face of the seat member and a second stabilizer fixed between the sidewalls along the back first edge and first face of the seat member.

9. The dual-height booster seat of claim 8, wherein elevation of the first height is in a range from 4 inches to 16 inches above the bench surface and elevation of the second height is in a range of from 2 inches to 8 inches above bench height.

10. The dual-height booster seat of claim 8, wherein the angle of the seat member is in a range from about 10 to about 15 degrees.

11. The dual-height booster seat of claim 10, wherein the angle of the seat member off-sets the rearward slope of the bench seating surface.

* * * * *